United States Patent [19]

Hirsch

[11] 4,056,919

[45] Nov. 8, 1977

[54] DIAPER PACKER

[75] Inventor: John L. Hirsch, Sheboygan Falls, Wis.

[73] Assignee: Curt G. Joa, Inc., Sheboygan Falls, Wis.

[21] Appl. No.: 736,041

[22] Filed: Oct. 27, 1976

[51] Int. Cl.[2] ..... B65B 63/02

[52] U.S. Cl. ..... 53/124 D; 53/159; 100/224

[58] Field of Search ..... 53/124 D, 124 E, 124 TS, 53/152, 153, 159; 100/224, 225

[56] References Cited

U.S. PATENT DOCUMENTS

| | | | |
|---|---|---|---|
| 1,659,831 | 2/1928 | Mudd | 53/152 X |
| 3,370,549 | 2/1968 | Livingston | 53/124 D X |
| 3,513,623 | 5/1970 | Pearson | 53/159 X |
| 3,585,925 | 6/1971 | Fox | 53/124 D X |

*Primary Examiner*—Travis S. McGehee
*Attorney, Agent, or Firm*—Joseph P. House, Jr.

[57] ABSTRACT

Apparatus for packing pads such as disposable diapers in shipping cartons includes one or more carriages having receptacles or bins with two open sides and an open top. The carriage moves the bins between a loading position where a stack of diapers is pushed into the bin and an unloading position where the stack is pushed horizontally through a carton packing funnel and into a carton. The diaper stack is confined against shifting during carriage movement by two vertical bin walls and two fixed panels which partially enclose the open sides of the bins as the carriage is moved between the panels to the unloading position. When the bin is in the unloading position the stack is compressed by a vertical ram having a compression plate which enters the open top of the receptacle. After the stack is compressed a pusher plate moves horizontally into one open side of the bin and out the other open side to push the compressed stack through a funnel and into a shipping carton held on the funnel.

5 Claims, 9 Drawing Figures

Fig. 4
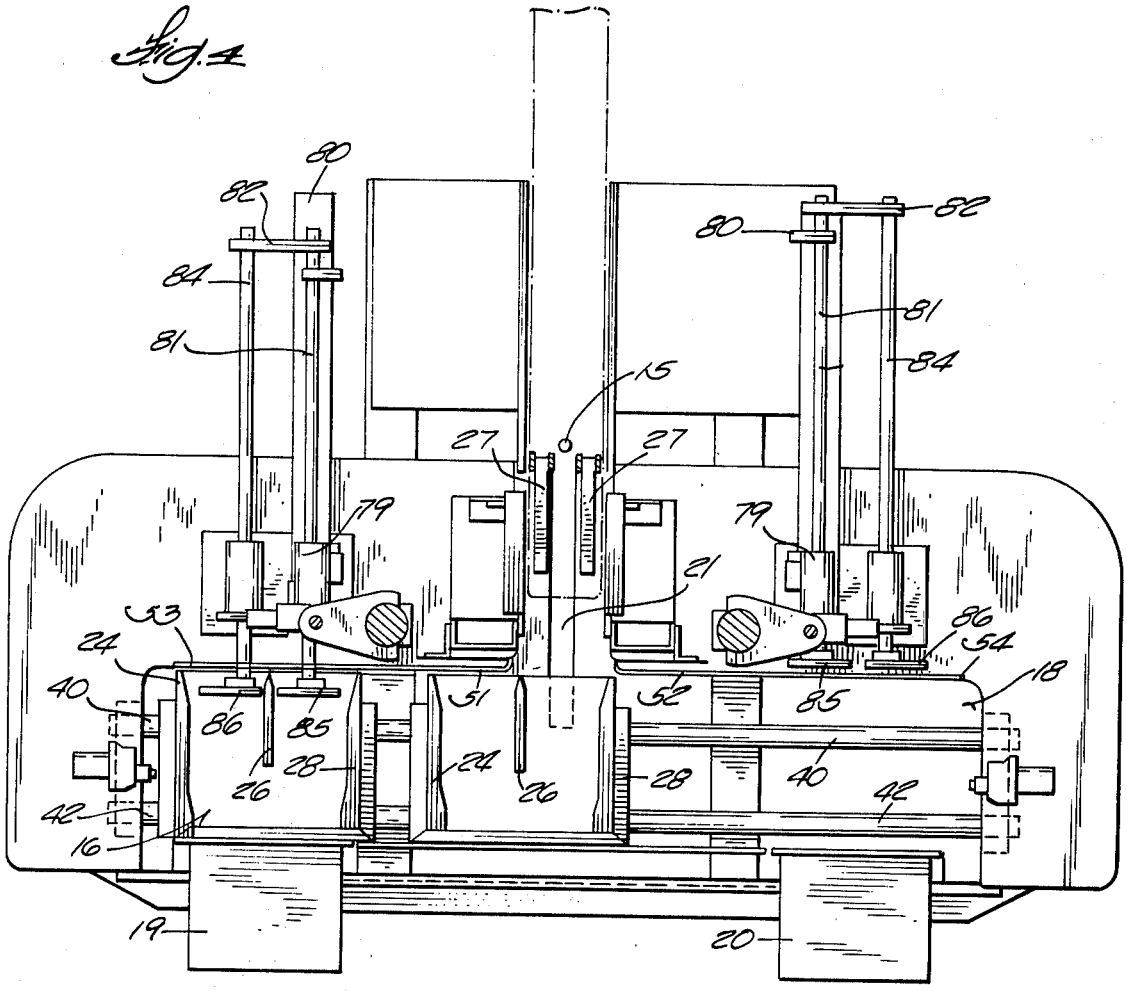
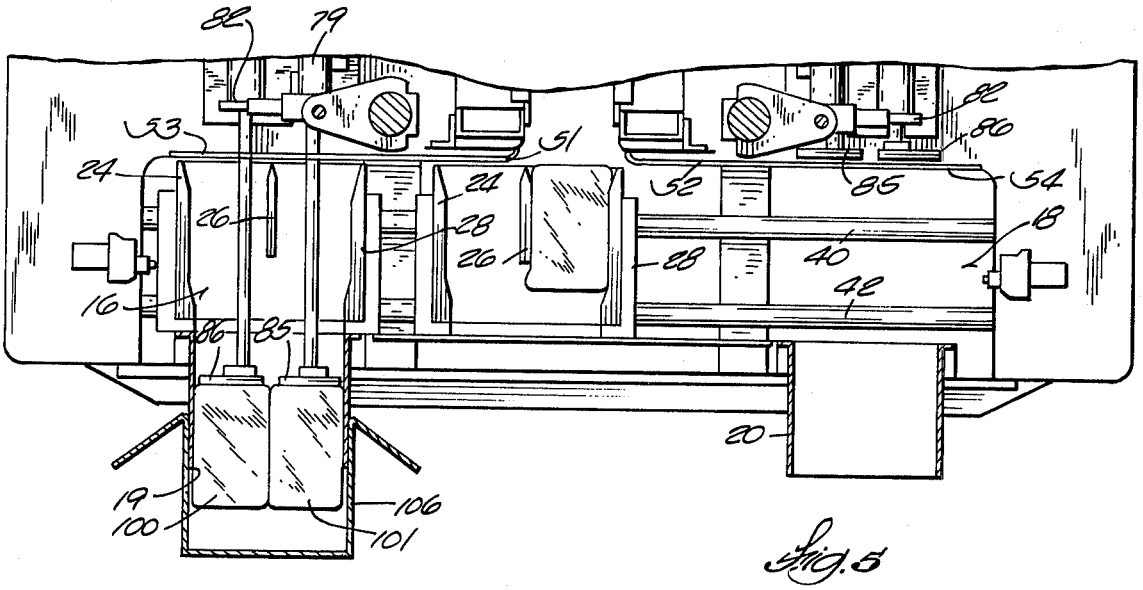
Fig. 5

DIAPER PACKER

BACKGROUND OF THE INVENTION

One form of conventional packing apparatus for sanitary pads such as disposable diapers typically includes two spaced loading funnels laterally spaced from a ferris wheel type elevator such as that shown in U.S. Pat. No. 2,324,930. This apparatus forms vertical stacks of pads delivered thereto by a conveyor. The stacks are then pushed to the spaced loading funnels where they are pushed horizontally by rams through the funnels and into cartons manually positioned on the funnels. To prevent the stacks from toppling or shifting out of alignment as the stacks are compressed between a top plate and skid plate they are pushed laterally from the elevator to the funnel. Friction of the top plate and skid plate on the diaper stack may cause some misalignment of the stack and abrasion and damage to the diapers.

SUMMARY OF THE INVENTION

The apparatus of the invention provides improved handling of stacks of pads without misalignment of the stacks or abrasion of the pads during movement of the stacks to the carton loading funnels. One or more carriages having a bin or receptacle defined by at least two spaced and parallel vertical walls receives stacks of diapers in one of the open bin sides. The diaper stacks are pushed into the bins by a pusher at the pad elevator. The vertical walls of the bin and front and rear laterally extending walls or panels on the frame enclose the open sides of the bin and confine the diaper stack as the stack is moved to a carton loading funnel. The bins are open at the tops and just prior to unloading of the pad stack through a funnel and into a carton, a vertical ram moves a pressure plate into the open top of the bin to compress the diaper stack. The compressed diaper stack is then pushed horizontally by a ram and pusher plate which moves into one open side of the bin and out the other open side of the bin and through the funnel.

Thus during movement of the stacks of diapers from the pad elevator to the loading funnel the diaper stacks are confined between vertical walls to prevent toppling of the stack but are not vertically compressed during this movement. The stack of diapers is not pushed on a skid plate as in prior art packers but is supported on the bottom plate of a movable carriage. This eliminates abrasion of the diapers. Compression of the stack occurs only after the diaper stacks have been moved to the unloading position at the funnel.

Further objects, advantages and features of the invention will become apparent from the disclosure.

DESCRIPTION OF DRAWINGS

FIG. 4 is a plan view of the apparatus shown in FIG. 2.

FIG. 5 is a view similar to FIG. 4 showing rams pushing two adjacent stacks of diapers through a loading funnel into a carton.

FIG. 9 is a diagrammatic view of the pusher mechanism for moving a stack of pads into the carriage diaper bins.

DESCRIPTION OF PREFERRED EMBODIMENT

Figure 1:
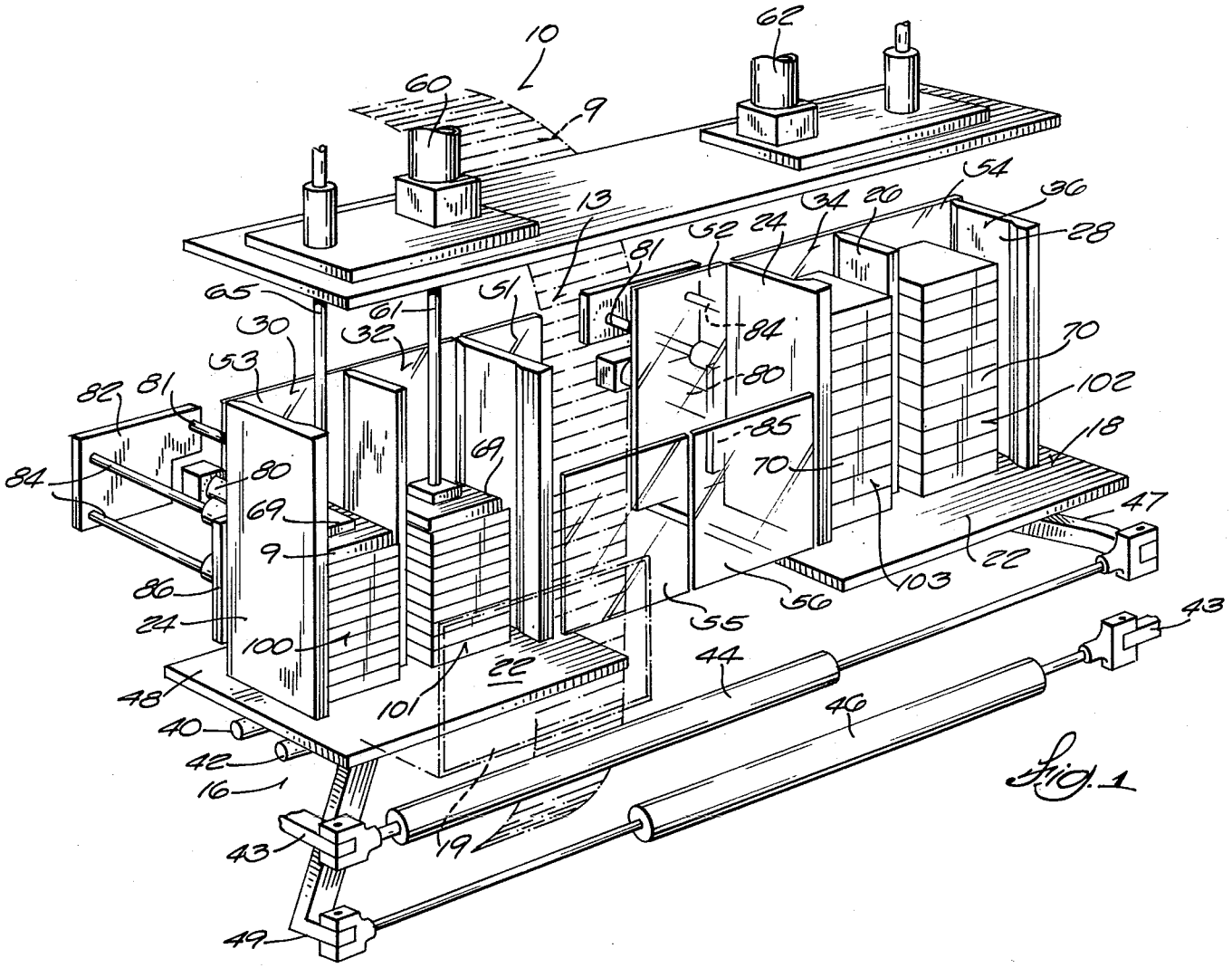
FIG. 1 is a diagrammatic and fragmentary perspective view of diaper packer apparatus embodying the invention.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

While the invention broadly relates to packing any compressible article, it will be exemplified herein as applied to sanitary pads such as sanitary napkins, hospital pads and disposable baby diapers, and particularly diapers.

The diapers or pads 9 are delivered to the packing apparatus of the invention by an infeed conveyor not shown. The pads are taken from the infeed conveyor by a ferris wheel type elevator 10 FIGS. 1, 3, and 9 which forms a pad stack 12 at a stack forming station 13. The packer apparatus includes a left carriage 16 and a right carriage 18 (FIG. 1) which are employed for conveying diaper stacks from the stack forming station 13 to spaced carton loading funnels 19 and 20 (FIG. 4, 6). Each carriage 16 and 18 is provided with a base or floor 22 (FIG. 1) and three vertical walls 24, 26 and 28 which define two stack receiving bins or cells 30, 32 on the left carriage 16 and two bins or cells 34 and 36 on the right carriage 18. A pusher 15 (FIG. 3,9) is provided for moving the pad stacks into the carriage bins in the form of an upstanding bar which is moved forwardly along the X axis (FIG. 6) by a power cylinder 17. The elevator 10 has spaced pad carrying flights 27 (FIG. 9,4) which deposit the diapers in the stack 12 on a bifurcated apron 21. The pusher bar 15 moves the stack along X axis onto the floor 22 of a bin. A power cylinder 23 lowers the pusher bar 15 and cylinder 17 beneath the apron 21 so that the pusher bar can be retracted free of the next pad stack which is being formed on the apron 21. The pusher bar 15 is then elevated for the next forward pushing sequence.

Although the illustrated embodiment employs two carriages with two stack receiving bins on each carriage 16, 18 for simultaneously loading two side by side stacks in a single carton, each carriage can employ two vertical walls for loading single stacks in a carton.

The purpose of utilizing two carriages is to expedite the loading process so that one carton can be loaded while another carriage is receiving stacks of diapers. However, a single carriage can be employed. The carriages 16 and 18 are mounted on common slide rods 40 and 42 which span the area in which the carriages 16, 18 shuttle back and forth between the loading and unloading positions.

Power cylinders 44 and 46 move the carriages 16 and 18 along the slide rods 40 and 42 between the carriage loading and unloading positions. The power cyclinder 44 is connected to the machine frame 43 (FIG. 2) and the piston rod is connected to a bracket 47 which is fixed to the carriage 18. The power cylinder 46 is connected by a bracket 49 to the carriage 22 and to the frame 43.

Figure 6:
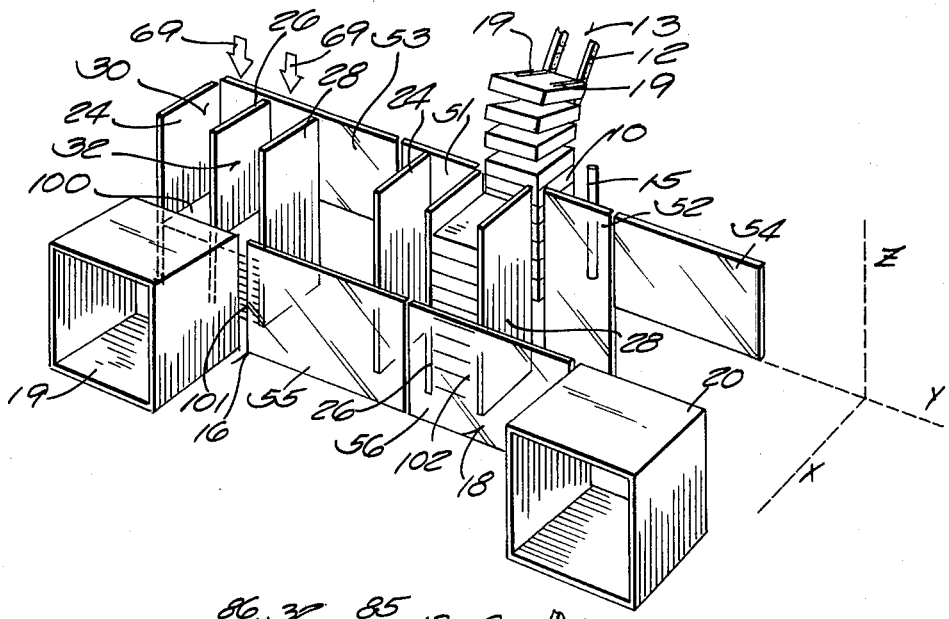
FIG. 6 is a diagrammatic view showing one sequence in operation of the apparatus with the left carriage positioned for unloading.
Figure 7:
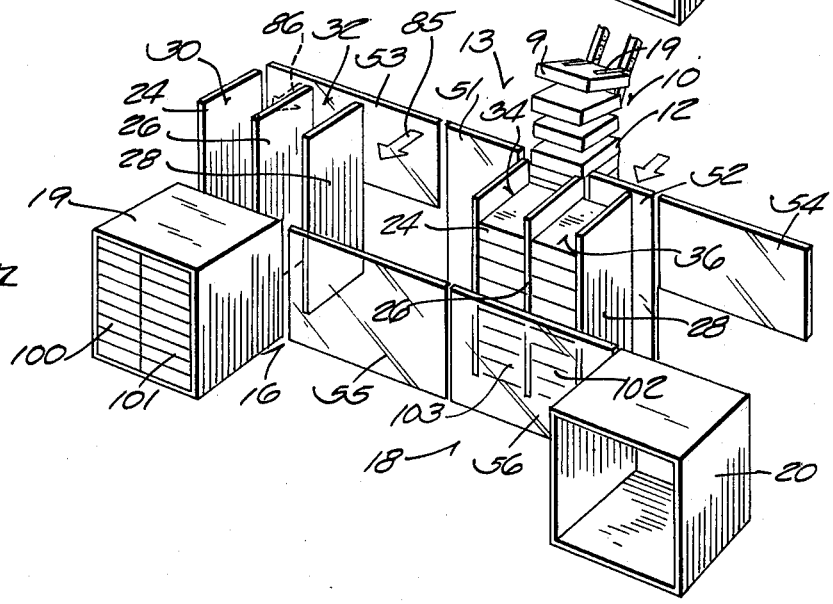
FIG. 7 is a view similar to FIG. 6 showing the right carriage moving to the right unloading position.
Figure 8:
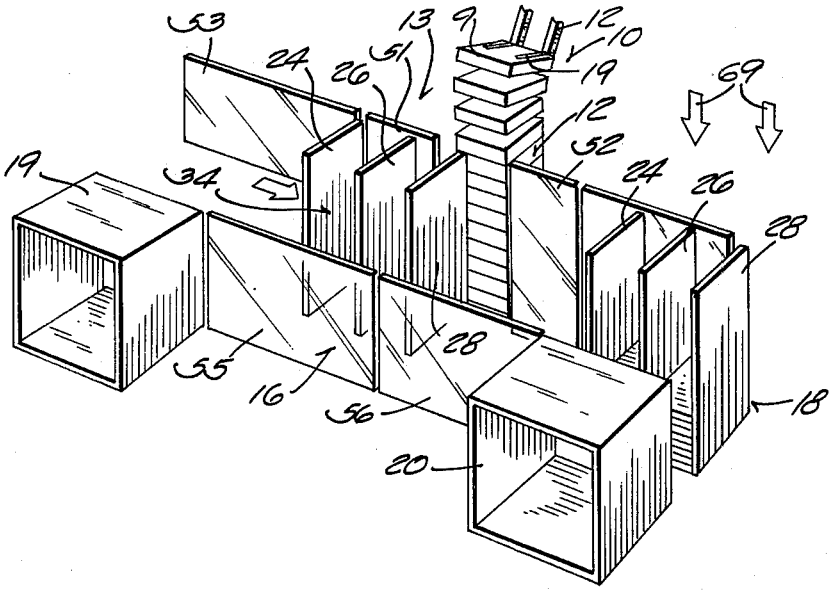
FIG. 8 is a further diagrammatic view showing the right-hand carriage positioned for unloading of diapers into the right funnel.

In FIG. 1 both carriages are shown in the unloading position and have stacks of diapers. Normally, however, one carriage is at the stack forming station 13 when the other carriage is positioned at its unloading station. The open sides of the carriage diaper bins are partially enclosed by fixed panels during movement of the carriages between the loading and unloading positions. As best illustrated in FIGS. 6, 7 and 8 the rear open sides of the loading bins are enclosed for their full height for a portion of the carriage travel by rear panels 51, 52 located on opposite sides of the stack forming station 13 and extending laterally thereof along an X axis. The rear panels 53 and 54 enclose only the upper part of the rear openings of the bins at the unloading position of the two carriages to enable pusher rams to move beneath the panels 53, 54 to push the diapers from the diaper bins as hereinafter described. The lower portion of the front openings of the bins are partially enclosed by two front panels 55, 56 which span the gap between the loading funnels 19 and 20.

The carriages 16 and 18 thus convey the diaper stacks laterally to alignment with the unloading funnels 19 and 20 without any vertical compression and without any skidding, friction and resulting abrasion. The bin walls, however and the front panels 55, 56 and rear panels 51, 52 confine the diaper stacks against toppling, shifting or misalignment which can interfer with pushing of the stacks into the shipping cartons.

Figure 2:
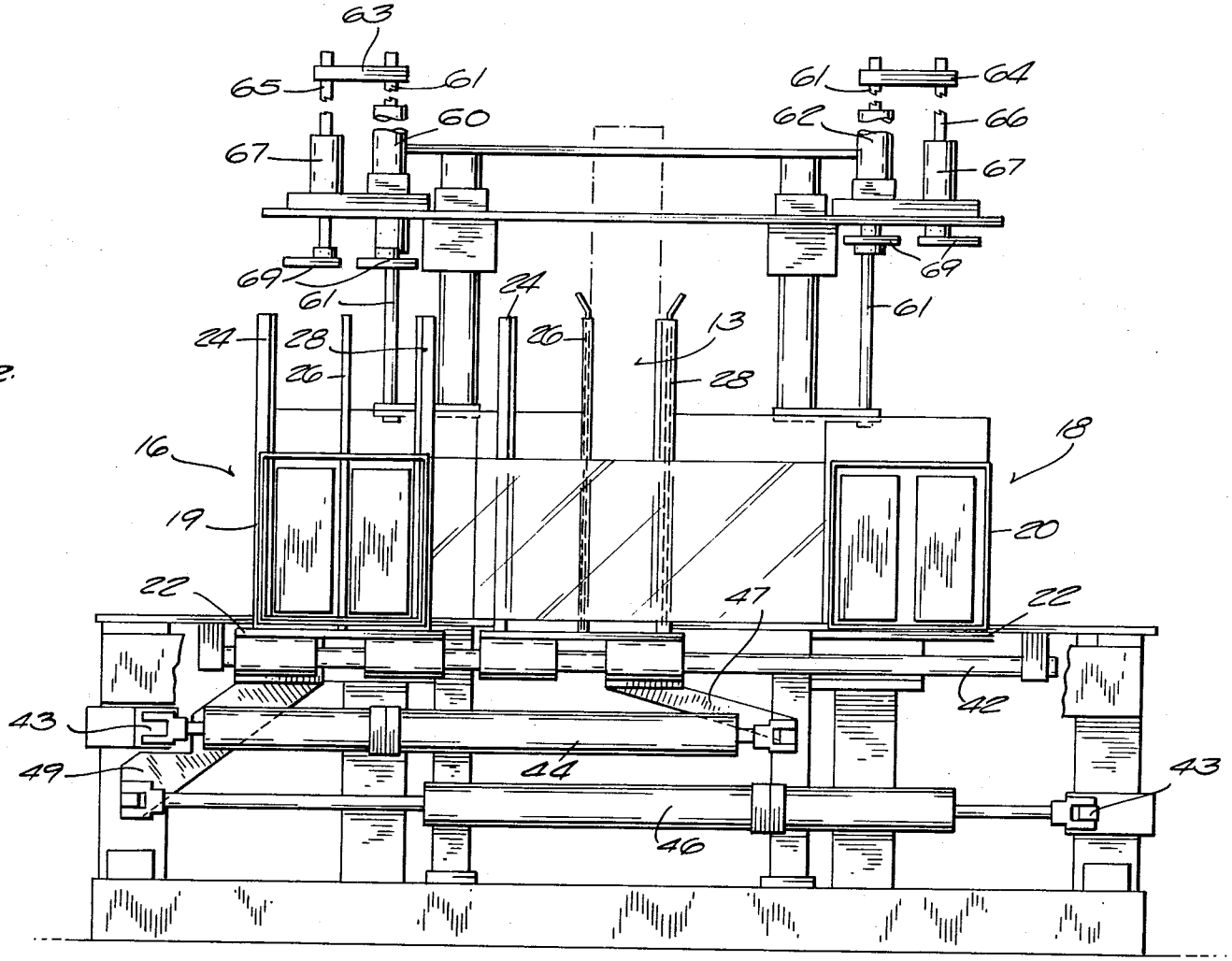
FIG. 2 is a front elevational view of the diaper packer.

Means are provided to compress the diaper stacks at the unloading stations before the diapers are pushed into the carton loading funnels. As disclosed, the means includes fluid cylinders 60 and 62 (FIG. 2). The piston rods 61 of the cylinders 60 and 62 are linked by brackets 63, 64 (FIG. 2) to slave rods 65, 66 which travel through bearings 67. Both the rods 61 and the rods 65, 66 are provided with pressure plates 69 which move through the open tops of the bins and within the vertical walls of the bins to compress the diapers. Thus there are separate pressure plates for each of the two diaper stacks on each carriage. As shown in FIG. 1 the pressure plates 69 for the left-hand carriage 16 are in the fully advanced position compressing the diapers to fit within the loading funnel 19. The pressure plates 69 for the right-hand carriage 18 are fully retracted and are not visible in FIG. 1.

Stack pushing means are provided for pushing the compressed stacks from the transfer bins 16, 18 through the loading funnels 19, 20 and into cartons 106 (FIGS. 3 and 5) manually placed on the funnels. As shown in FIGS. 1 4, 5, the stack pushing means for each carriage 16, 18 comprises a power cylinder 80 with the cylinders 80 connected to the machine frame 43. The piston rods for the cylinders 80 are connected to stack pusher plates 85 which align with bin cells 32, 34. The adjacent pusher plates 86 for the second diaper stack on each carriage are driven by a connection to the powered plates 85 by upper rods 81 which are also connected to the pusher plates 85 and supported in bearings 79 (FIG. 4). Pusher plates 86 align with bin cells 30, 36. The upper rods 81 are connected to back plates 82 (FIGS. 4 and 5) which are connected to rods 84 which drive pusher plates 86. FIG. 4 shows the pusher plates 85, 86 for the left-hand carrier 16 in a partially advanced position entering the diaper bin and FIG. 5 shows said pusher plates in a more fully advanced position extending partially into the loading funnel 19.

FIGS. 6, 7 and 8 show the operational sequence of the pad packing apparatus. In FIG. 6 the left carriage 16 and its diaper bins or cells 30, 32 are aligned with the left funnel 19. The diaper stacks 100 and 101 in bins 30, 32 have been compressed by the pressure plates 69 which move vertically along a Z axis. The right carriage 18 is located at the stack forming station 13 and one stack of diapers 102 has been pushed by the pusher bar 15 which moves along the X axis through the elevator and to the diaper bin 36.

In FIG. 7 the stacks 100, 101 of diapers in bins 30 and 32 have been pushed along a horizontal or X axis into the loading funnel 19 by pusher plates 85, 86. The right hand carriage 18 is in the course of being shifted to the right along the Y axis for transferring diaper stacks 102, 103 in the bins 34, 36 into alignment with funnel 20.

Figure 3:
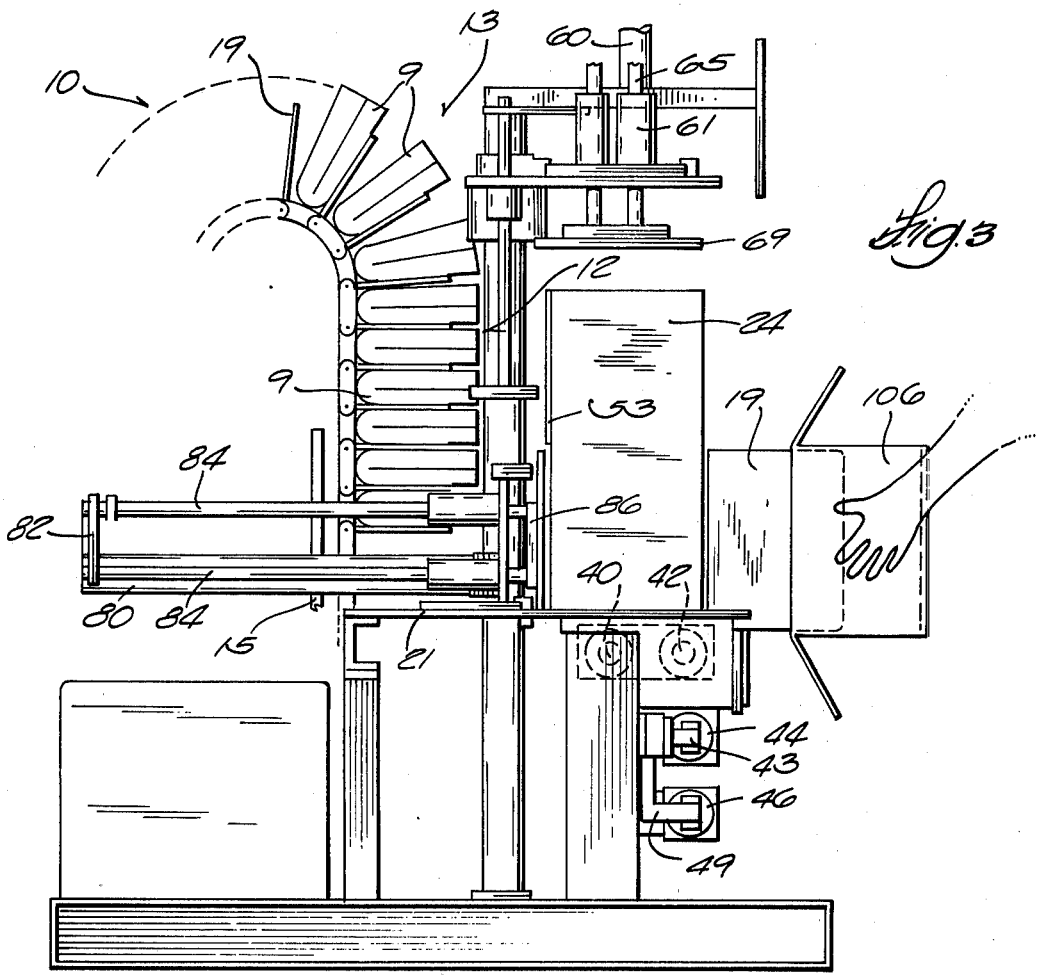
FIG. 3 is a side elevational view of the apparatus shown in FIG. 2.
Figure 2:
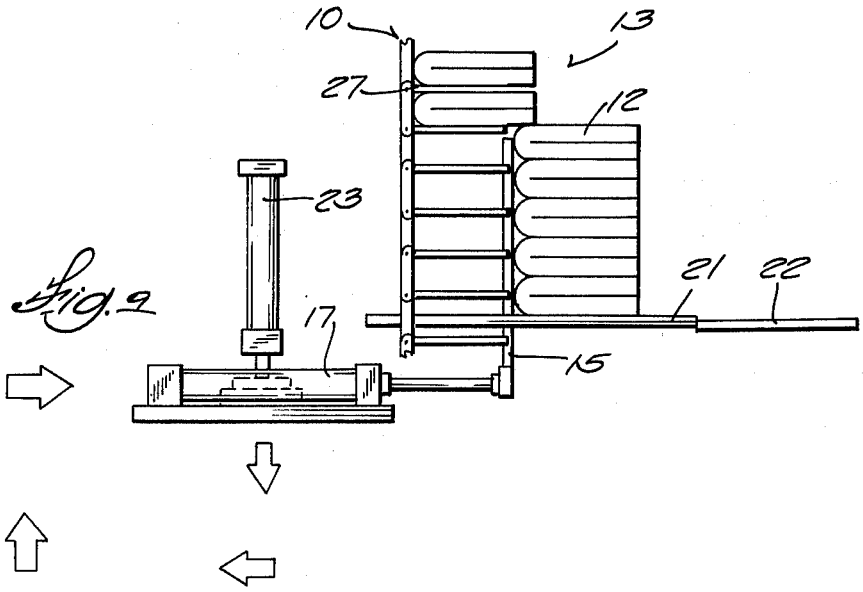

FIG. 8 shows the unloaded left carriage 16 shifted to the right along the X axis to the stack forming station 13 to receive stacks of diapers. The diaper stacks on carriage 18 have been compressed and are ready to be pushed forwardly on the X axis for discharge through the loading funnel 20 and into a carton 106 (FIGS. 3 and 5). Carton 106 is manually held in partially telescoped relation over the loading funnel 19 as the diaper stacks 100, 101 are simultaneously pushed through the funnel 19 into the carton 106.

I claim:

1. Apparatus for packing compressible articles in cartons comprising means for forming a stack of the articles oriented along a Z axis at a stack forming station, a carriage having a stack carrying receptacle having spaced walls for confining a stack agains lateral shifting during carriage movement, means for moving the stack onto said carriage and within said receptacle, means for moving the carriage along a Y axis transverse to the Z axis and between a stack receiving position at the stack forming station and a stack unloading station, pusher means for pushing the stack from the receptacle at the unloading station along an X axis transverse to said Z and Y axes and into a shipping carton, and stack compression means for compressing and maintaining said article stack under compression along the Z axis while said articles are pushed in the direction of the X axis and wherein said receptacles are upwardly open on two sides along the X axis and said stack compressing means comprises a pressure plate, and means for reciprocating the pressure plate along the Z axis to engage and compress the article stack, and wherein said pusher means for pushing the compressed stack from the receptacles along the X axis comprises a pusher plate reciprocatable along the X axis through the open sides of the receptacle and including front and rear panels parallel to the Y axis and spaced to receive the carriages therebetween and confine the article stack during carriage movement along the Y axis.

2. Packing apparatus in accordance with claim 1 wherein there is clearance between said rear panels and said pusher means.

3. Apparatus for packing compressible articles in cartons comprising means for forming a stack of articles at a stack forming station, a stack unloading station, a loading funnel at the unloading station, a first carriage having a stack receiving bin with a bin bottom and upstanding walls for supporting and confining the stack against lateral shifting during carriage movement said bin being open on two sides and having an open top, means for moving the stack onto said carriage and within said bin, means for moving the carriage between said stack forming station and said stack unloading station, pusher means operable through said bin open sides for pushing the stack into said funnel when said bin is in registry with said funnel at the unloading station and compression means operable through said bin open top for compressing said articles in said bin during movement of the stack into said funnel from said bin, including a second carriage, means for moving said second carriage independently of said first carriage, two packing funnels spaced laterally from said stack forming station to afford simultaneous loading of stacks on one carriage and unloading of stacks from the other carriage at a packing funnel.

4. Apparatus in accordance with claim 3 wherein said carriage bin includes two spaced parallel walls and a central dividing wall for confining two stacks of pads and said compression means includes two pressure plates each plate engagable with one of said stacks.

5. Apparatus in accordance with claim 3 including fixed panels arranged along the path of carriage movement to partially enclose the open bin sides to prevent shifting of the articles in the stack through the bin sides during movement of the carriage between the stack forming station and stack unloading station.

* * * * *